US006102773A

United States Patent [19]

Wu et al.

[11] Patent Number: 6,102,773

[45] Date of Patent: Aug. 15, 2000

[54] PERFUMED BRASSIERE

[76] Inventors: Li-Pin Wu, No. 174, Min Chuan Road, Chung-Li City, Tao-Yuan Hsien; Shu-Fen Lin, No. 2, Lane 111, Wen Chang Street, Pa-Te City, Tao-Yuan Hsien; Tung-Jung Wu, No. 7, Lane 112, Wen Chang Street, Pa-Te City, Tao-Yuan Hsien, all of Taiwan

[21] Appl. No.: 09/188,705

[22] Filed: Nov. 10, 1998

[51] Int. Cl.[7] ..... A41B 9/00

[52] U.S. Cl. ..... 450/1; 450/57; 450/38; 239/36; 2/1; 512/4

[58] Field of Search ..... 450/1, 53, 57, 450/54, 30, 55, 31, 56, 32, 89; 239/36, 152, 153; 512/1, 4; 2/1, 83, 46, 48, 49.1, 80, 247, 75, 248, 249, 104–106, 15, 113, 114, 251–253, 250

[56] References Cited

U.S. PATENT DOCUMENTS

| | | | |
|---|---|---|---|
| 2,124,396 | 7/1938 | Frank | 2/244 X |
| 2,200,840 | 5/1940 | Frank | 2/244 X |
| 2,526,087 | 10/1950 | Schoolman et al. | 63/14 |
| 2,806,315 | 9/1957 | Kalensky | 63/14 |
| 3,185,394 | 5/1965 | Farrell | 239/36 |
| 4,277,024 | 7/1981 | Spector | 239/36 |
| 4,465,232 | 8/1984 | Field | 239/36 |
| 4,744,514 | 5/1988 | Gadoua | 239/36 |
| 5,399,404 | 3/1995 | Laughlin et al. | 239/36 |
| 5,678,251 | 10/1997 | Getz | 2/406 |
| 5,899,790 | 5/1999 | Berg | 450/1 |

*Primary Examiner*—Gloria Hale
*Attorney, Agent, or Firm*—Rosenberg, Klein & Lee

[57] ABSTRACT

A perfumed brassiere in which solid form perfume materials are arranged on the periphery of hard support elements at the bottom edges of the cups or are insertably provided in between layers of fabric of the brassiere. Soft pieces of perfume materials are fitted into the cups or in between the fabric layers around the cups. The perfumed materials are coupled to the brassiere as a whole to send out sweet smell for a prolonged period of time.

7 Claims, 13 Drawing Sheets

PERFUMED BRASSIERE

BACKGROUND OF THE INVENTION (a) Field of the Invention

The present invention relates generally to an improved brassiere structure, and more particularly to a perfumed brassiere that can send out fragrance for a prolonged period of time.

(b) Description of the Prior Art

There are various kinds of brassieres, but their structure basically comprises left and right cups 1 and a strap 2, as shown in FIG. 1. The strap 2 may or may not include shoulder straps 21. Besides, most of them have a curved hard support element 3 provided at a bottom edge of each cup 1, which is generally a wiring. The fabric at the bottom of the cup 3 is sew ed to form to folded portion 11 inside which the supporting element 3 is secured to give support to the cup 1. In addition, the soft pad 4 is disposed between the outer fabric layer and the inner fabric layer. Generally, the pad 4 is made of foamed material or multi-layered cotton cloth.

Women like to put on some perfume, especially during the menstrual period and to cover up odor. However, liquid form perfume can last about four hours only. Besides, some people are allergic to perfume and cannot withstand spraying of perfume on their skin.

As women wear brassieres almost 24 hours of the day, if they are configured to be able to send out fragrance for a prolonged period of time, it will be a benefit to women.

SUMMARY OF THE INVENTION

A primary object of the present invention is to provide a perfumed brassiere which can send out fragrance for a prolonged period of time, in which a solid form perfume material that can endure washing is coupled with the cup of the brassiere to achieve prolonged emission of fragrance.

Another object of the present invention is to provide a perfumed brassiere which can send out fragrance for a prolonged period of time, in which a solid form perfume material is fixedly disposed in the brassiere or removably disposed therein to allow replacement thereof, and will not make the brassiere uncomfortable to wear.

A further object of the present invention is to provide a structure of perfumed brassieres which can send out fragrance for a prolonged period of time, in which the surface edge of periphery of the cup is provided with an opening at a suitable position for receiving and positioning a soft and thin piece of perfume or deodorant to continuously emit fragrance.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
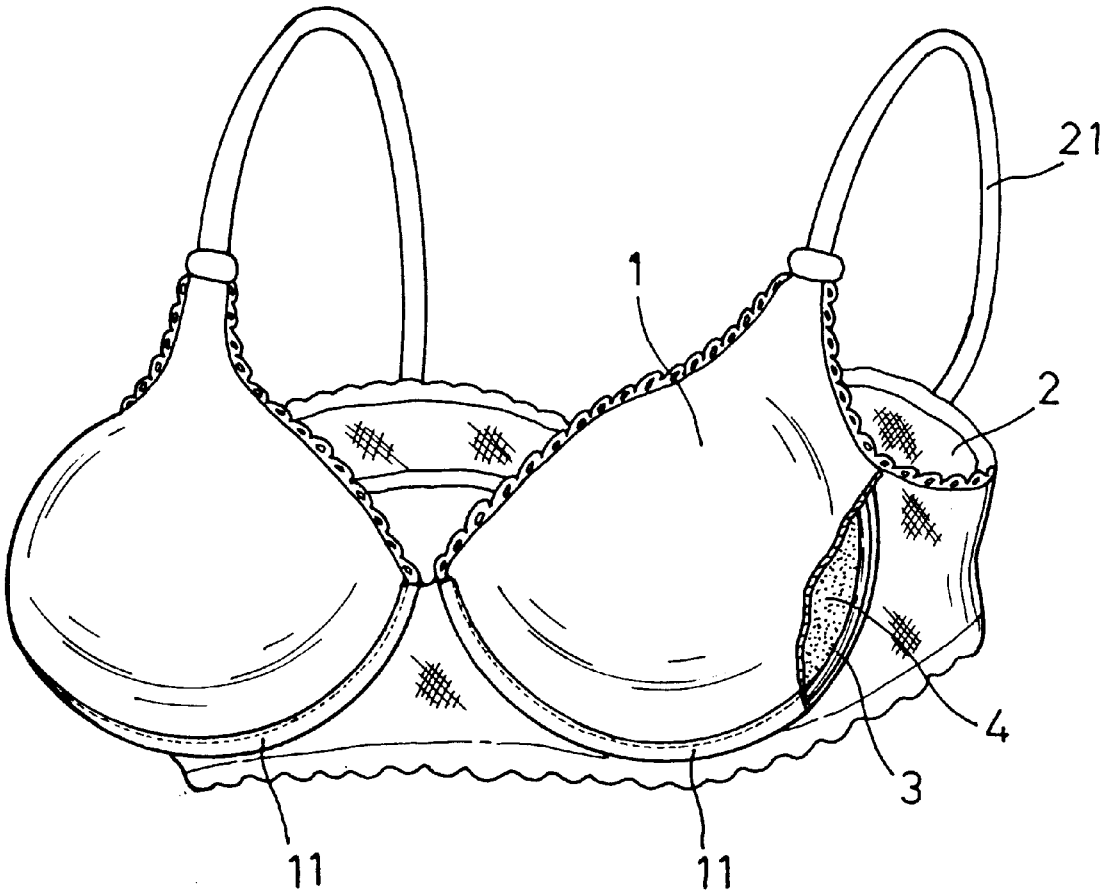
FIG. 1 is a schematic view of a conventional brassiere.
Figure 2:
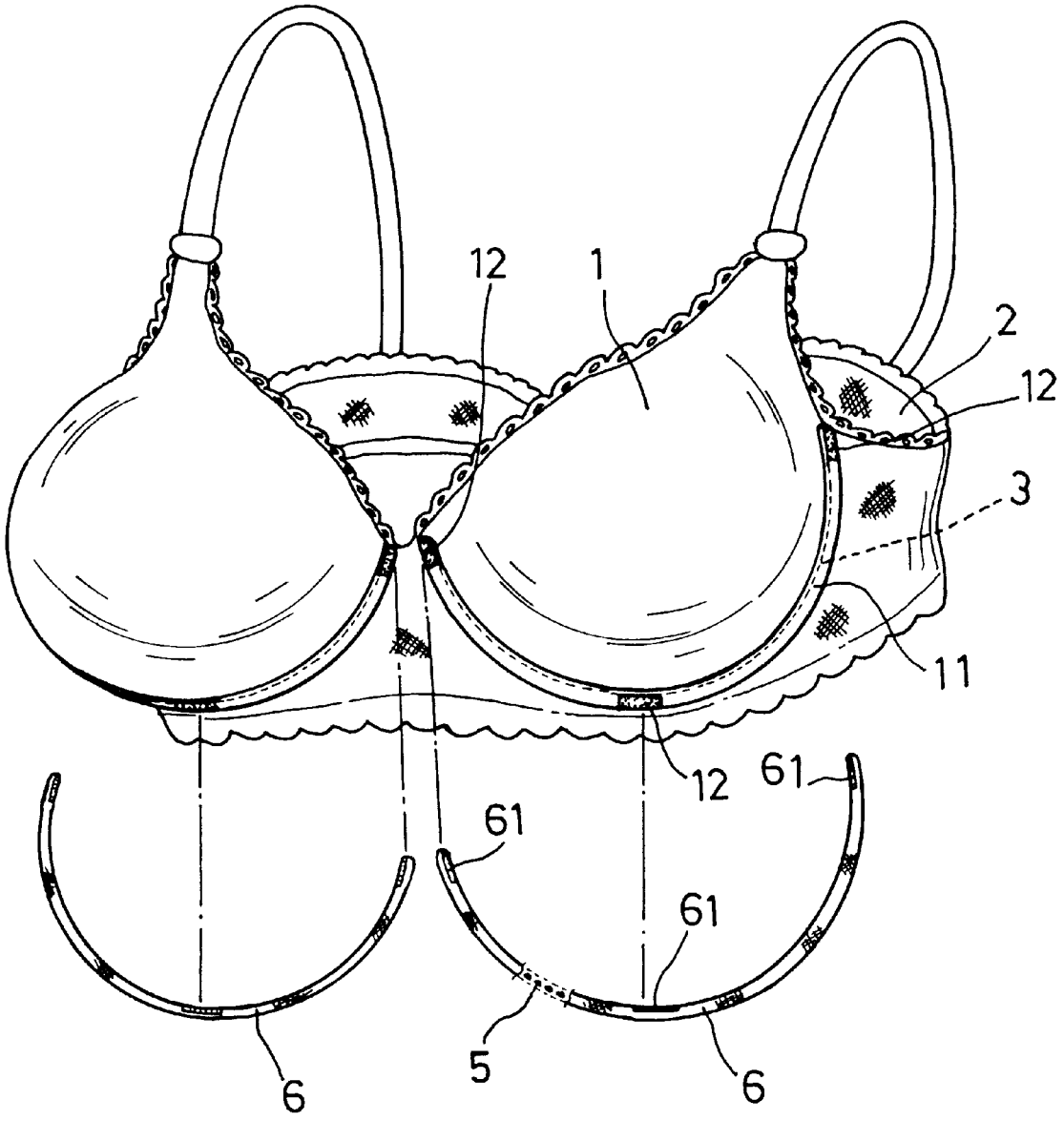
FIG. 2 is a perspective exploded view of the first preferred embodiment of the present invention.
Figure 3:
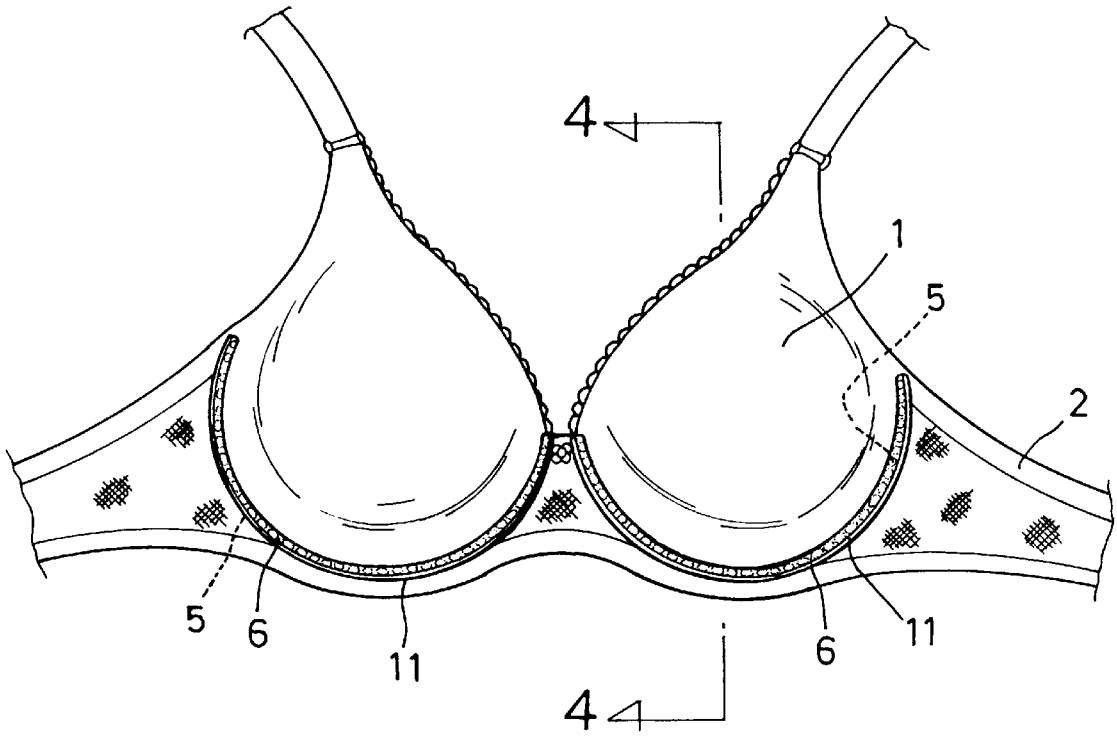
FIG. 3 is an assembled schematic view of the first preferred embodiment.
Figure 4:
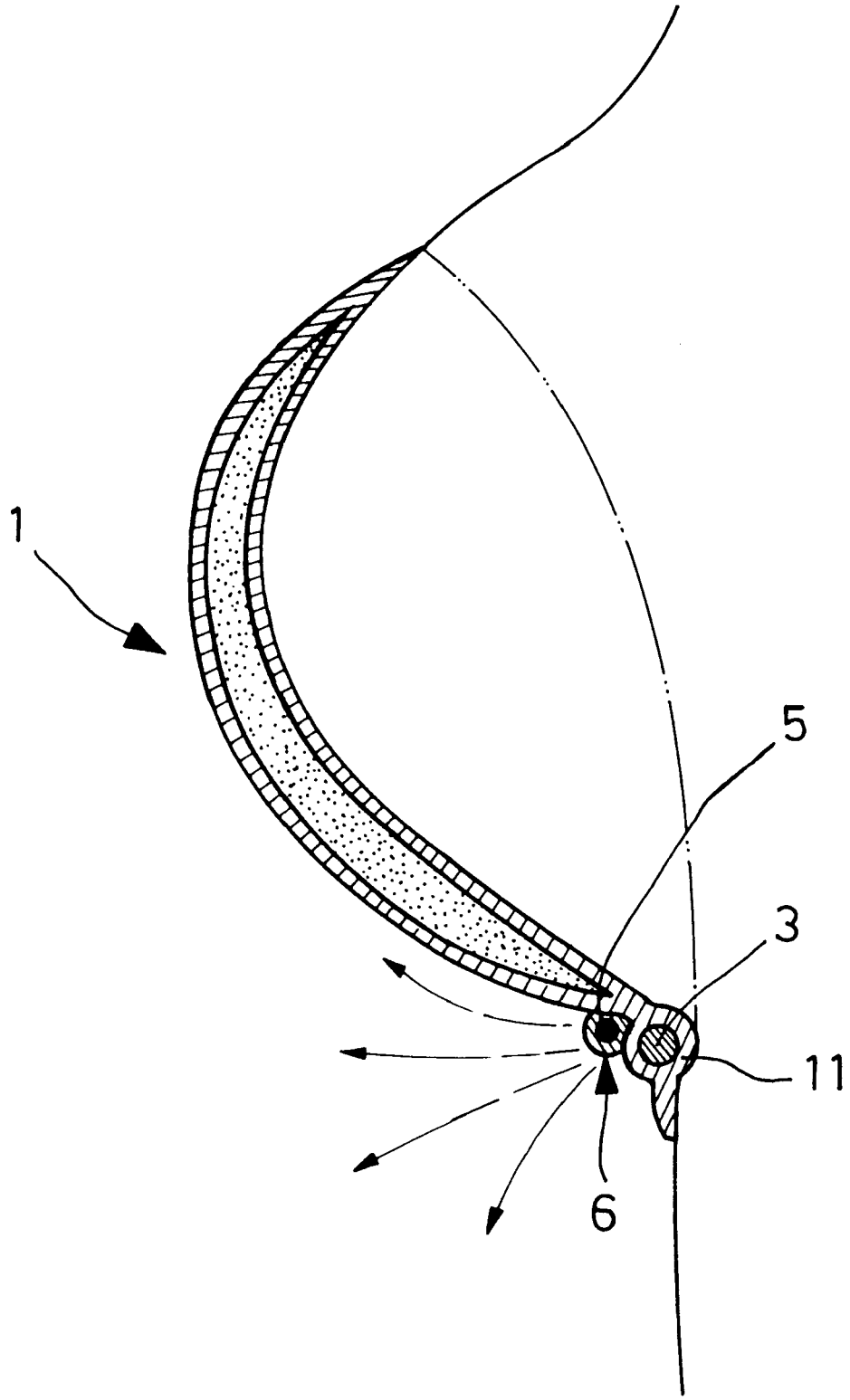
FIG. 4 is a sectional view taken along line 4—4 of FIG. 3.

With reference to FIG. 2, the perfumed brassiere according to the present invention essentially comprise left and right cups 1, and strap 2. A bottom edge of each cup 1 is provided with a folded portion 11 in which a hard support element 3 is secured. As the above belongs to the prior art, it will not be discussed in detail herein. As the hard support elements 3 are sewed at the bottom edges of the cups 1, it will not make the brassiere uncomfortable to wear. The first preferred embodiment of the present invention utilizes such a structural characteristic of brassieres. A non-liquid form perfume material is made into solid form perfume materials 5 that can endure washing. The perfume materials 5 is disposed inside a strip-shaped air permeable sac 6, which can be made from air permeable cloth or equivalent materials so that the scent of the perfume materials 5 can diffuse to the environment. Furthermore, the strip-shaped air permeable sac 6 is sewed to the periphery of the folded portion 11 so that it is coupled to the cup 1 as a whole. Alternatively, the folded portion 11 is provided with a coupling element 12 at a suitable position, and the strip-shaped air permeable sac 6 is correspondingly provided with a coupling element 61 such that the strip-shaped air permeable sac 6 can be attached to the folded portion 11 along the contour of the folded portion 11 so as to be coupled to the cup 1 as a whole, as shown in FIGS. 3 and 4.

The size and shape of the solid form perfume materials 5 can be made as required, and should be able to resist washing. After it is disposed inside the strip-shaped air permeable sac 6, it can continue to emit sweet smell. As the strip-shaped air permeable sac 6 is coupled to the cup 1 along the periphery of the folded portion 11, it is also fixed in position by the hard support element 3. And in use, it will not make the wearer feel uncomfortable.

The above-mentioned coupling elements 12, 61 may be known hooks-and loops tapes or equivalent means so that the strip-shaped air permeable sacs 6 can be detached for replacement. A plurality of strip-shaped air permeable sac 6 containing perfume materials 5 of different scent can be used to provide variety.

Figure 5:
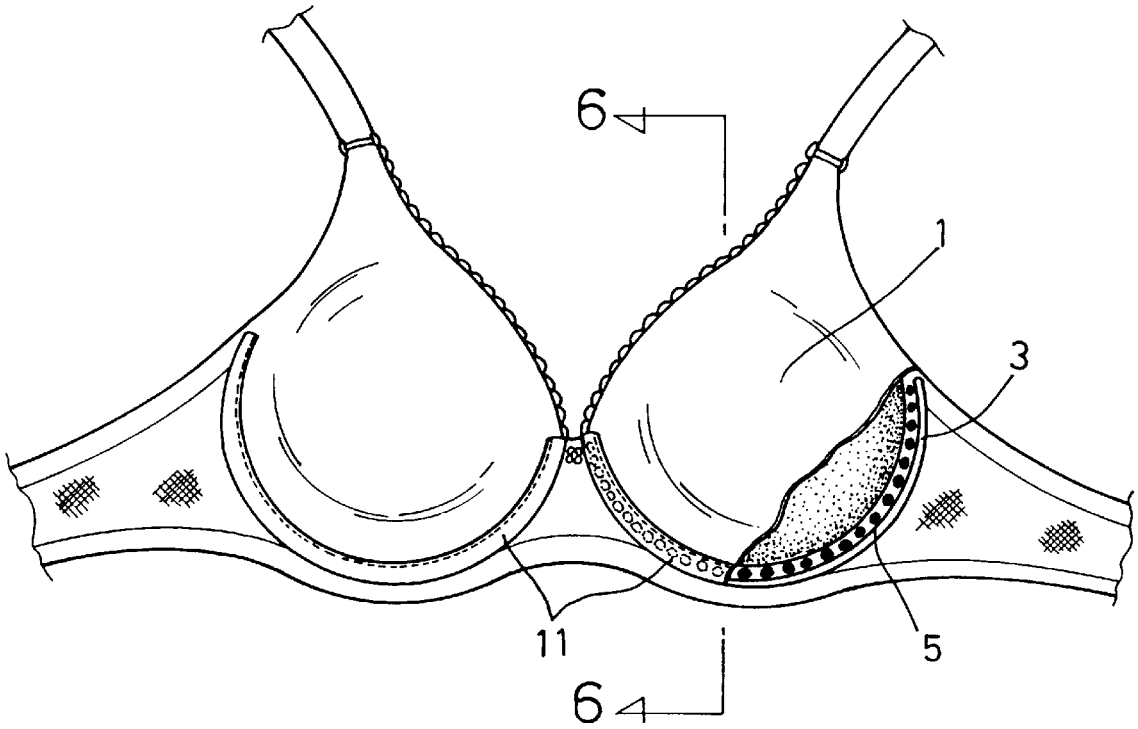
FIG. 5 is a schematic view of the second preferred embodiment of the present invention.
Figure 6:
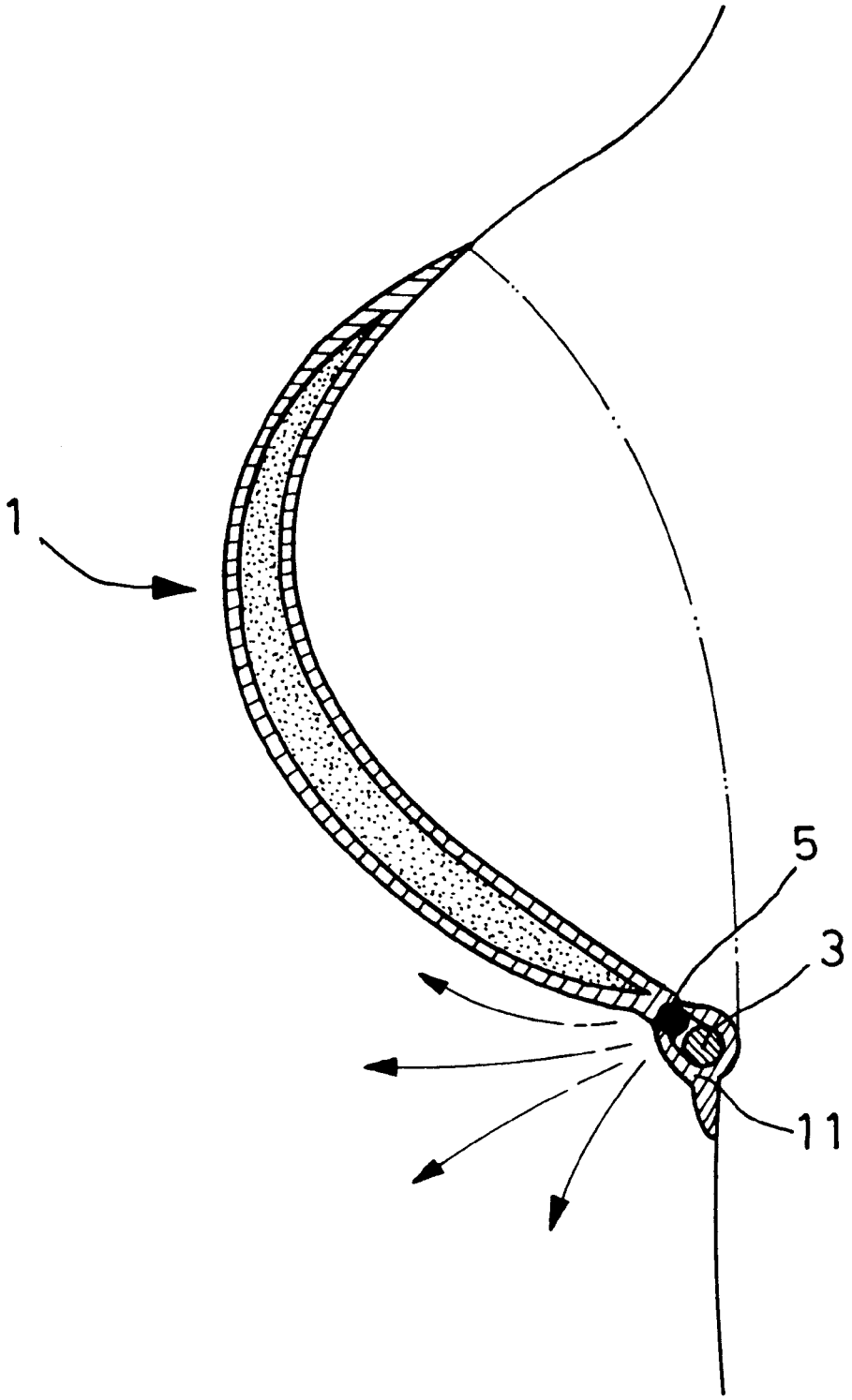
FIG. 6 is a sectional view taken along line 6—6 of FIG. 5.

Referring to FIGS. 5 and 6, which illustrate the second preferred embodiment of the present invention, the solid form perfume materials 5 are arranged along the periphery of the curved hard support element 3 so that they are directly wrapped inside the folded portion 11 with the hard support element 3.

Figure 7:
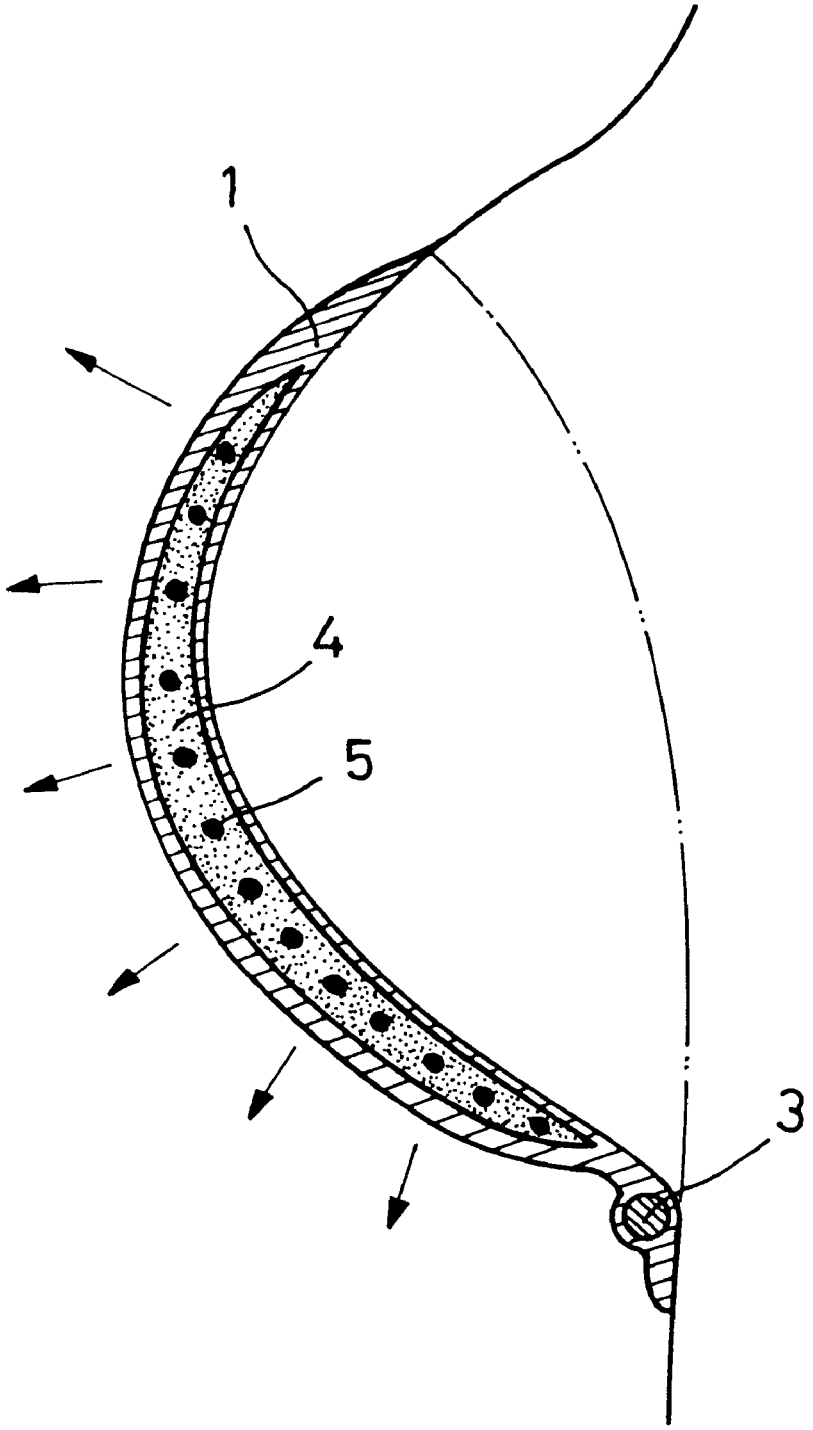
FIG. 7 is a schematic view of the third preferred embodiment of the present invention.

FIG. 7 shows the third preferred embodiment of the present invention. A pad 4 is disposed between outer and inner cloth layers of the cup 1. The pad 4. as in the prior art, is made from foamed material or multi-layered cotton cloth. A plurality of solid form perfume materials 5 that can resist washing are distributed on the pad 4 so that they can be coupled to the cup 1 as a whole to continuously send out fragrance.

Figure 8:
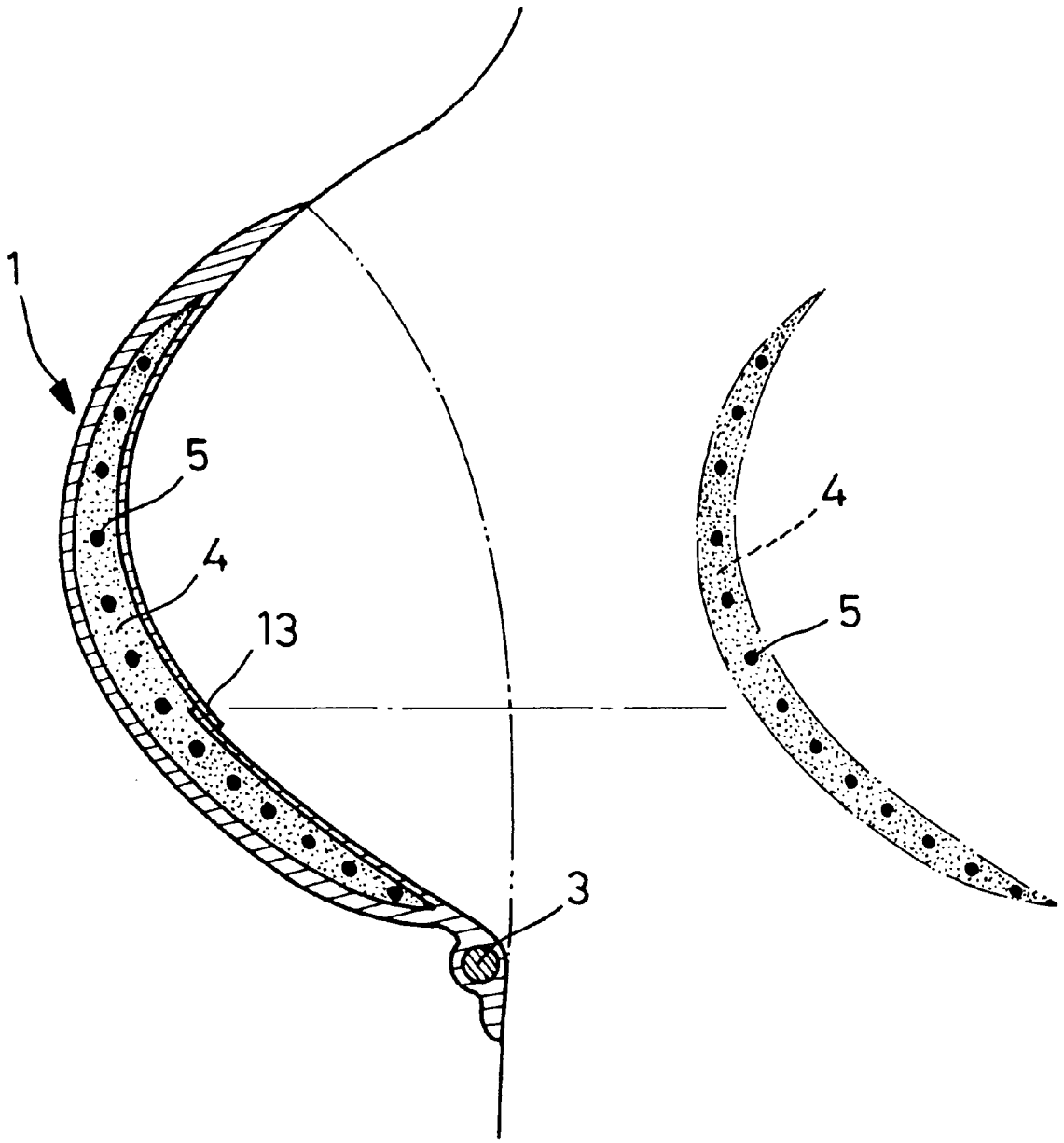
FIG. 8 is a schematic view of the fourth preferred embodiment of the present invention.

FIG. 8 shows the fourth preferred embodiment of the present invention. The inner cloth layer of the cup 1 is provided with an opening 13 at a suitable position to allow removal or replacement of the pad 4. Hence, the wearer can change pads 4 with perfume materials 5 of different scent to give more variety.

Figure 9:
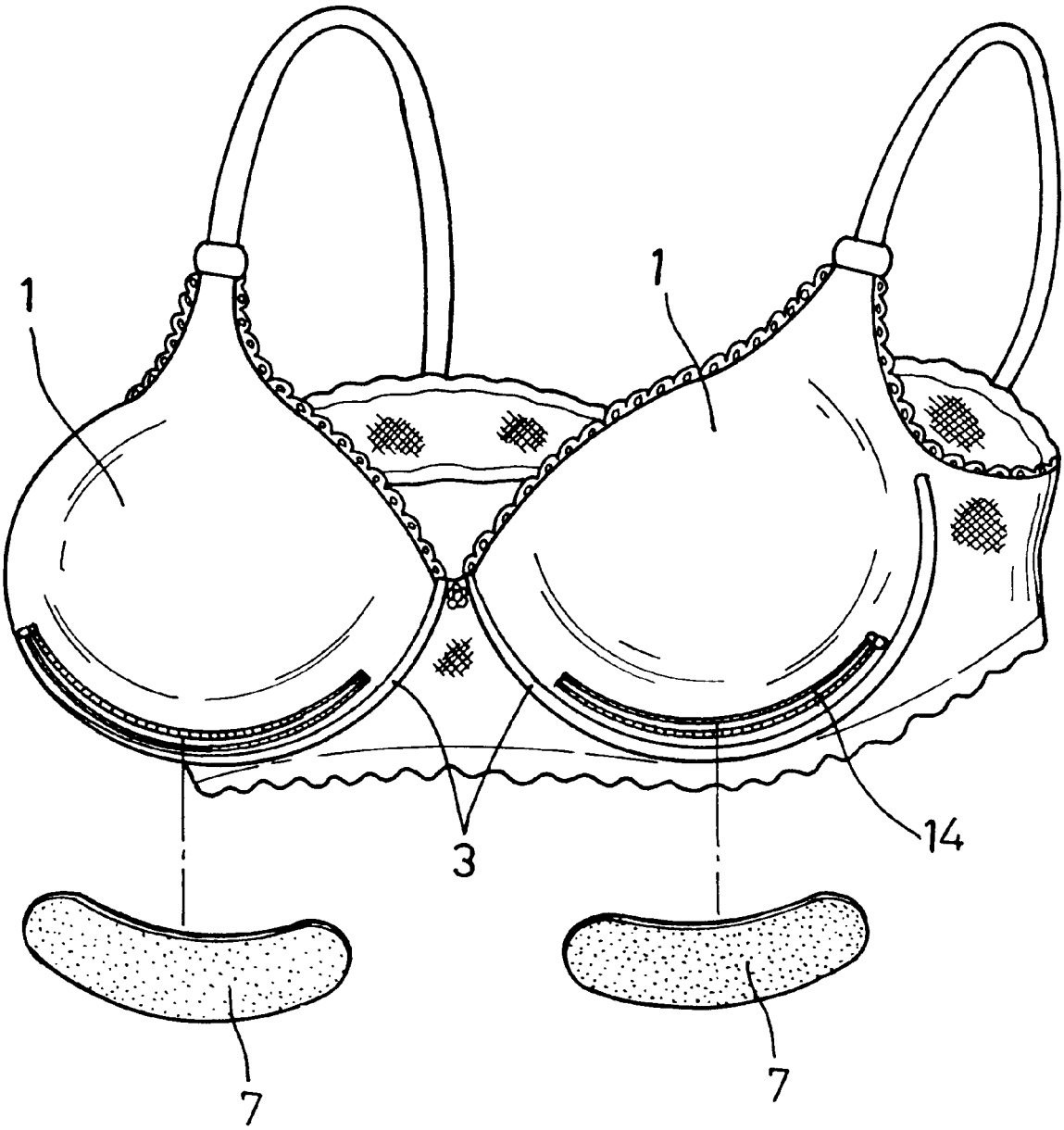
FIG. 9 is a perspective exploded view of the fifth preferred embodiment of the present invention.
Figure 10:
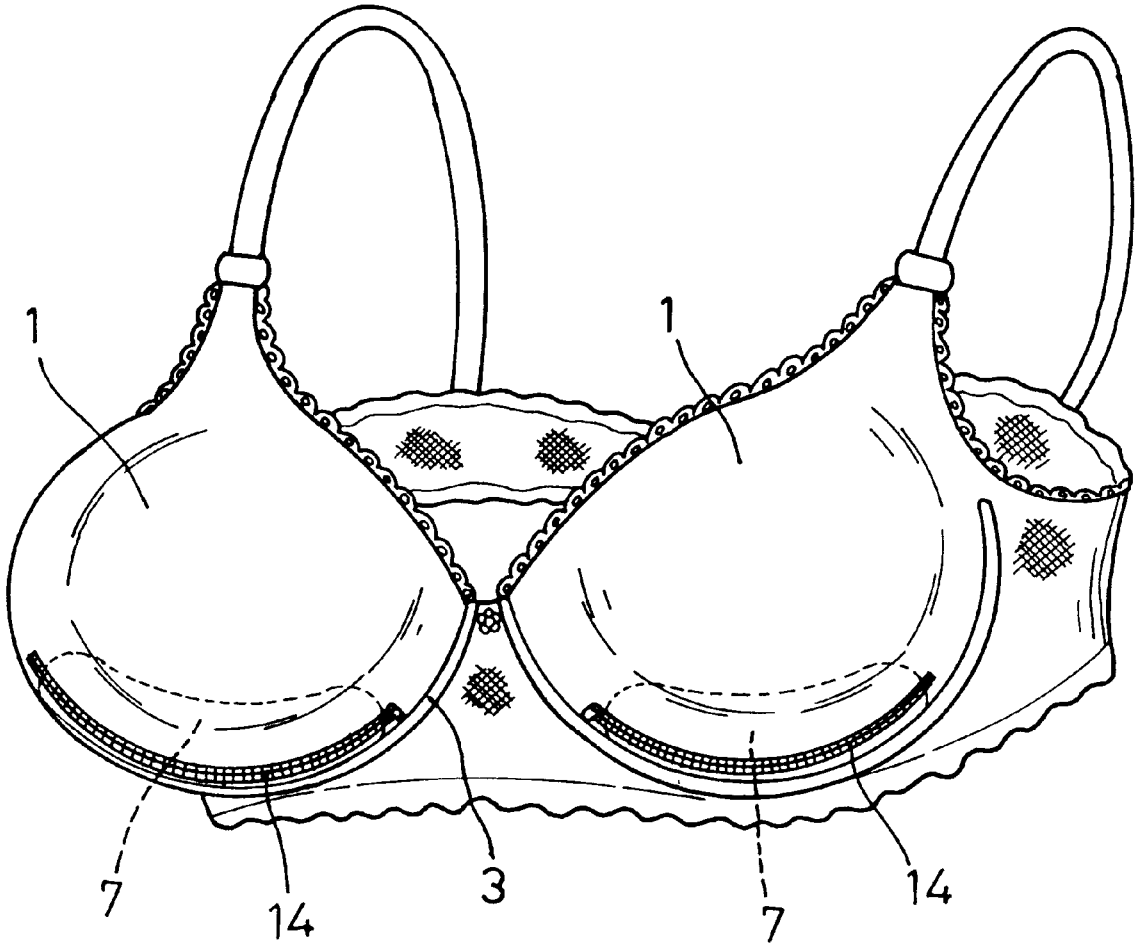
FIG. 10 is a schematic view illustrating the fifth preferred embodiment in use.

FIGS. 9 and 10 show the fifth preferred embodiment of the present invention. A placement slit 14 is provided on the surface of each cup 1 for receiving a soft and thin perfume piece 7 fitted thereinto so that the perfume piece 7 can be positioned in the cup 1. Since the cup is made of air permeable material, the sweet smell of the perfume piece 7 can be diffused to the outside. The scent of the perfume piece 7 should last at least 48 hours, so that it is more lasting than perfume spray.

Furthermore, the placement slits 14 can be configured to be closable by using hooks-and-loops tapes or zippers. Preferably, the placement slits 14 are provided near the bottom edges of the cups 1 near the hard support elements 3 so that they do not make the brassiere uncomfortable to wear or affect the appearance.

Figure 11:
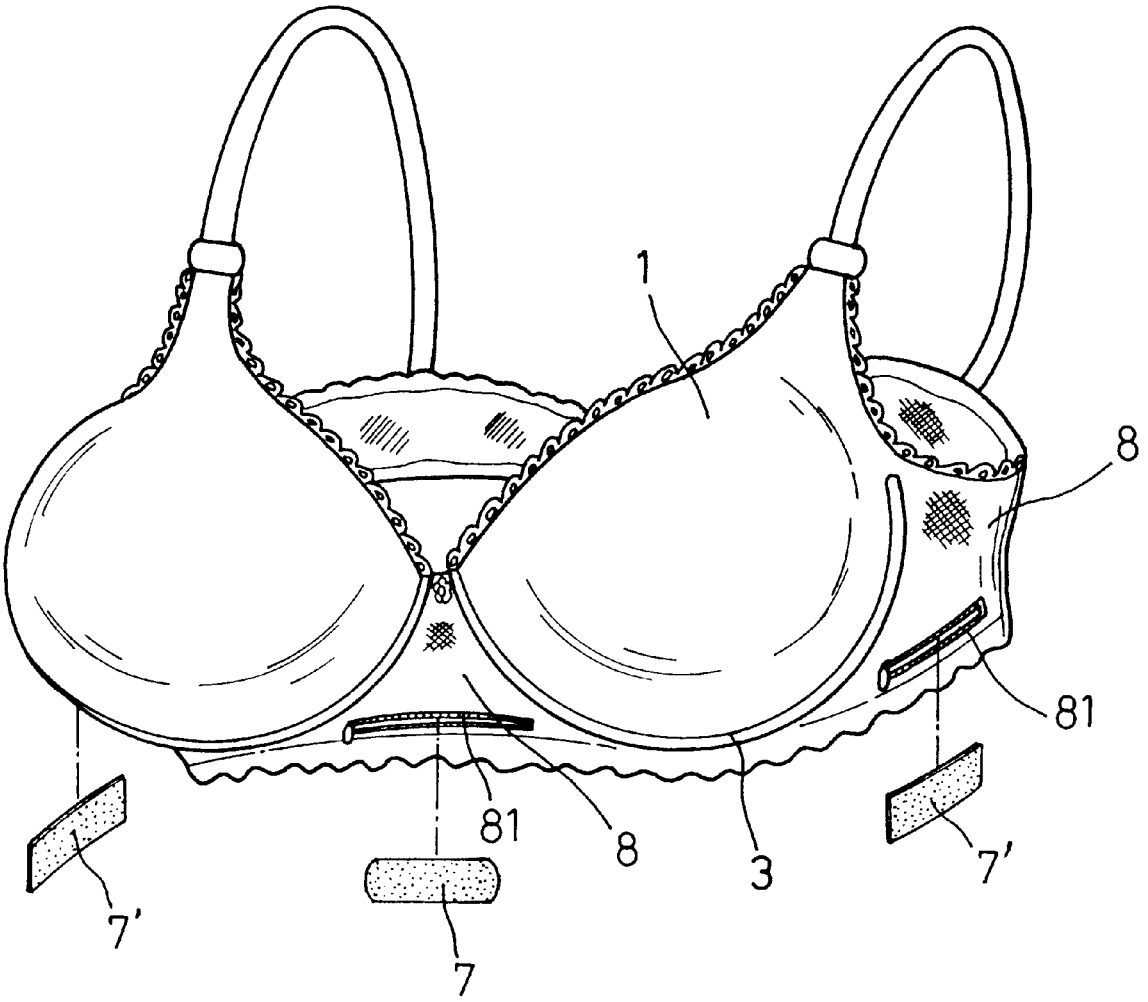
FIG. 11 is a perspective exploded view of the sixth preferred embodiment of the present invention.
Figure 12:
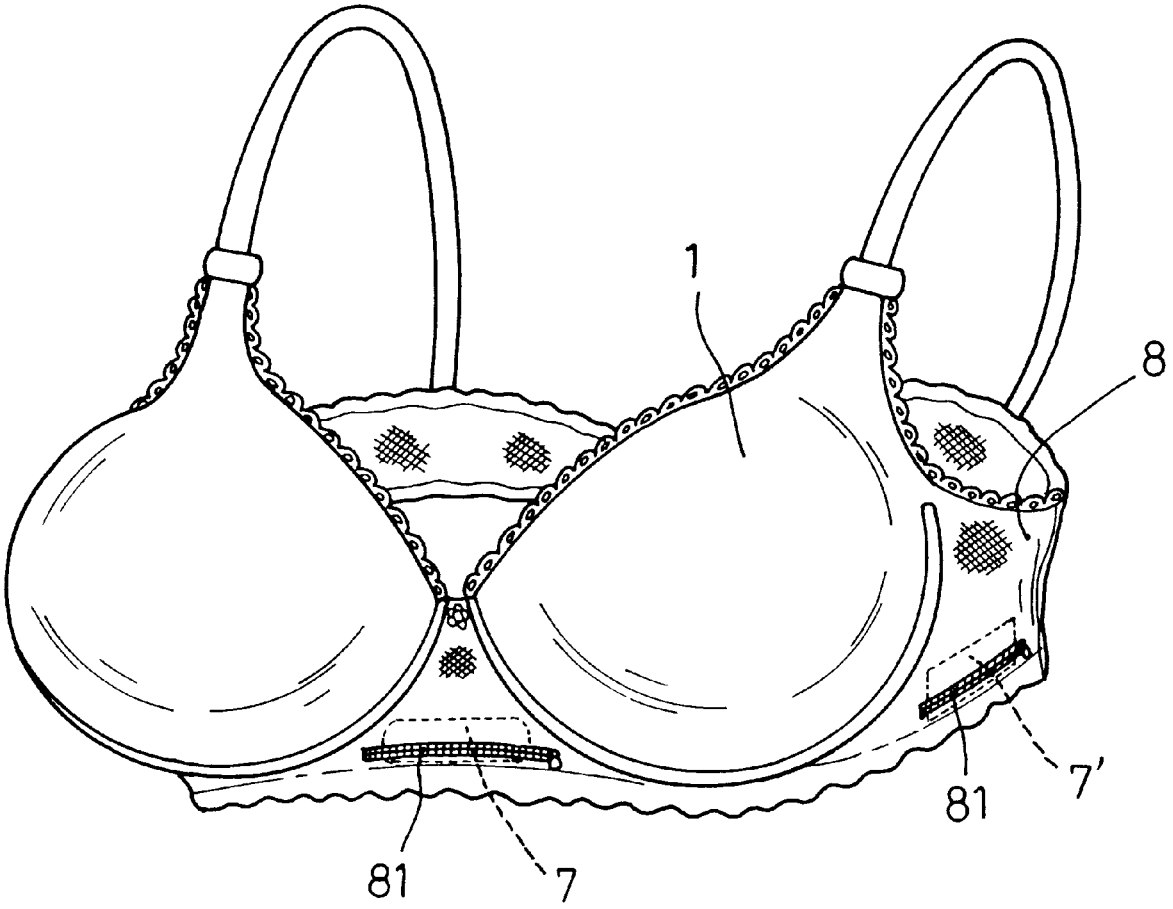
FIG. 12 is a schematic view illustrating the sixth preferred embodiment in use.

FIGS. 11 and 12 illustrate the sixth preferred embodiment of the present invention. The lace or lining material 8 around the cups 1 is configured to be double-layered, and a placement slit 81 is provided in one of the layers at a suitable position for receiving the soft and thin perfume piece 7 or a deodorant piece 7' so that the perfume piece 7 or deodorant piece 7' is positioned between the two layers. Placement slits 81 may be provided on the lace or lining material 8 below the armpits to achieve better deodorizing effects. The perfume pieces 7 or deodorant pieces 7' are easily replaceable after they are consumed.

Figure 13:
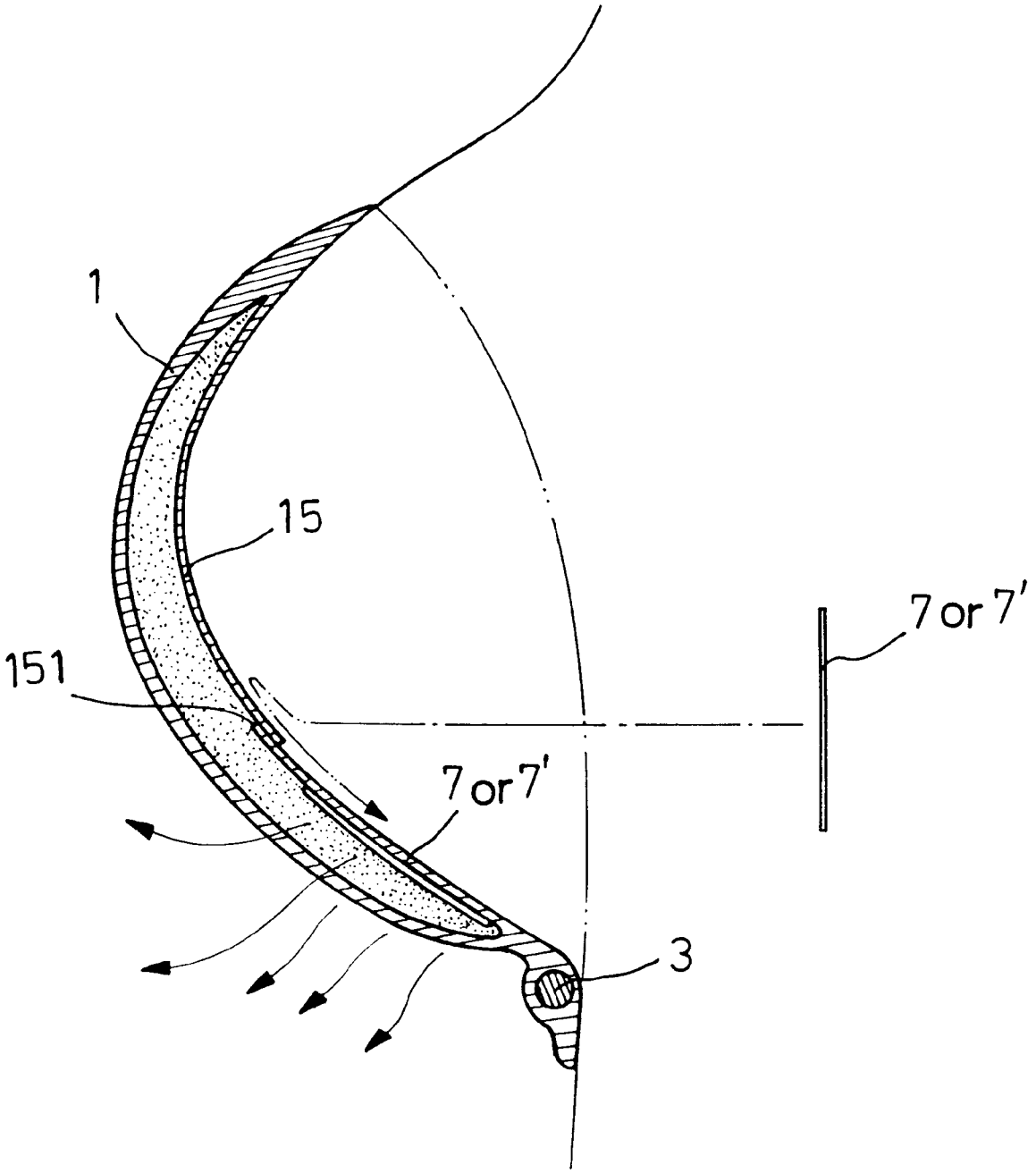
FIG. 13 is a schematic view of the seventh preferred embodiment of the present invention.

FIG. 13 shows the seventh preferred embodiment of the present invention. An inner lining material 15 of the cup 1 is provided with a placement opening 151 into which the perfume piece 7 or deodorant piece 7' can be fitted so that the scent can come out through the surface of the cup 1.

The above-mentioned perfume pieces 7 or deodorant pieces 7 are configured to be thin paper or cloth that will not affect the appearance of the brassieres or affect the wearers' comfort in wearing the brassiere.

From the foregoing, it can be appreciated that the brassiere of the present invention are comfortable to wear after installation of the solid form perfume materials 5 or placement of the perfume pieces 7 or deodorant pieces 7'. Besides, the sweet smell can come out through the air permeable sacs 6 or the cups 1 or the lining material 8. The perfume materials 5 or perfume pieces 7 or deodorant pieces 7' are much more lasting than perfume spray or deodorant spray.

Although the present invention has been illustrated and described with reference to the preferred embodiment thereof, it should be understood that it is in no way limited to the details of such embodiment but is capable of numerous modifications within the scope of the appended claims.

What is claimed is:

1. A perfumed brassiere comprising:

a first brassiere cup having a first bottom edge, said first bottom edge forming a first fabric enclosure;

a second brassiere cup having a second bottom edge, said second bottom edge forming a second fabric enclosure;

first and second support elements fixedly secured within said first and second fabric enclosures;

first and second solid perfume elements fixedly secured solely to said first and second bottom edges adjacent said first and second support elements respectively, wherein said first and second solid perfume elements emit varying scents.

2. The perfumed brassiere as defined in claim 1, wherein said perfume elements are solid form perfume materials that are sewed to inner edges of first and second fabric enclosures of the cups together with the hard support elements.

3. The perfumed brassiere as defined in claim 2, wherein the solid perfume elements are secured inside strip-shape air permeable sacs that are secured on outer or inner sides of the first and second fabric enclosures of the cups by coupling elements.

4. The perfumed brassiere as defined in claim 1, wherein said perfume elements are soft, thin pieces of perfume that are inserted into surface edges of said cups.

5. The perfumed brassiere as recited in claim 1, wherein said perfume elements are soft, thin pieces of deodorant secured within surface edges of said first and second cups.

6. The perfumed brassiere as recited in claim 1, wherein said perfume elements are soft, thin pieces of perfume secured between layers of fabric forming said first and second brassiere cups.

7. The perfumed brassiere as recited in claim 1, wherein said perfume elements are soft, thin pieces of deodorant secured between layers of fabric forming said first and second brassiere cups.

* * * * *